United States Patent [19]

Chavez

[11] Patent Number: 5,033,161

[45] Date of Patent: Jul. 23, 1991

[54] DOOR HINGE WITH KNUCKLE CYLINDER HAVING A MAJOR BEVELED PORTION

[76] Inventor: Joseph G. Chavez, 905 Sioux Ct., SE., Vienna, Va. 22180

[21] Appl. No.: 462,084

[22] Filed: Jan. 8, 1990

[51] Int. Cl.[5] ..... E05D 7/10

[52] U.S. Cl. ..... 16/262; 16/254

[58] Field of Search ..... 16/262, 254

[56] References Cited

U.S. PATENT DOCUMENTS

| | | | |
|---|---|---|---|
| 2,775 | 10/1867 | Smith . | |
| 17,354 | 5/1857 | Smith . | |
| 83,393 | 10/1868 | Maschauer Frankfurth . | |
| 182,893 | 10/1876 | Clark . | |
| 202,958 | 4/1878 | Patterson . | |
| 1,021,885 | 4/1912 | Peterson . | |
| 1,030,801 | 6/1912 | Berault . | |
| 1,062,623 | 5/1913 | Waters . | |
| 1,196,428 | 8/1916 | Briel | 16/262 |
| 1,860,438 | 5/1932 | Thies . | |
| 2,978,736 | 4/1961 | Walker | 16/380 |

FOREIGN PATENT DOCUMENTS

| | | | |
|---|---|---|---|
| 656916 | 7/1986 | Switzerland | 16/254 |

OTHER PUBLICATIONS

"Redesigned Butt Hinge", American Builder, Mar. 1954, p. 190.

*Primary Examiner*—Robert L. Spruill
*Assistant Examiner*—Carmine Cuda
*Attorney, Agent, or Firm*—James Creighton Wray

[57] ABSTRACT

A modification of conventional removable pin butt hinges, such as used to hang doors, simplifies removal of the hinge pin. The modification is a beveled surface portion along an upper end edge of the uppermost hinge cylinder, providing access to an exposed ledge portion of the hinge pin crown. A driver, a chisel, a screwdriver or other driving device may be positioned against the exposed portion of the hinge pin and struck, thereby easily driving the hinge pin from the hinge cylinder.

6 Claims, 1 Drawing Sheet

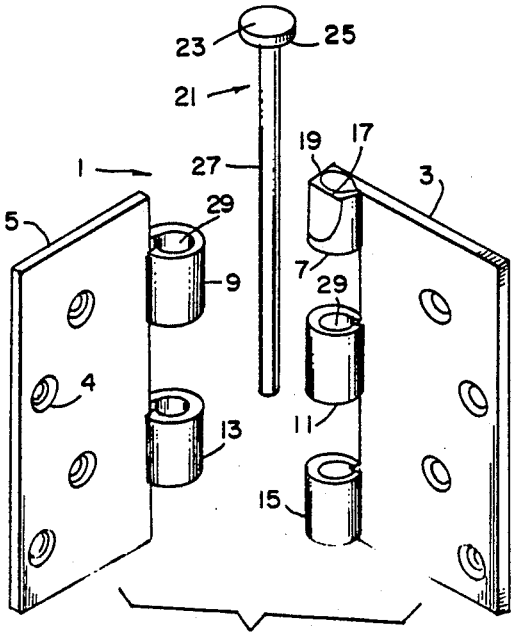
FIG. 1
FIG. 2
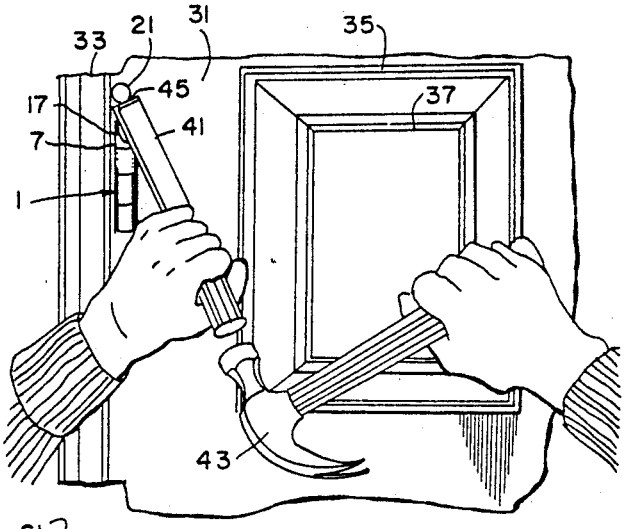
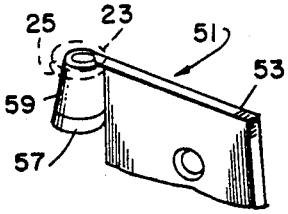
FIG. 3
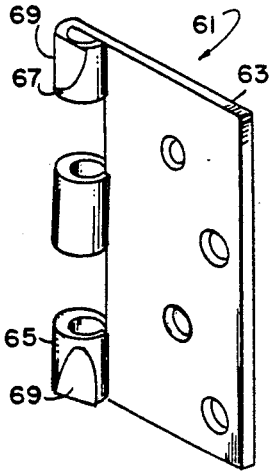
FIG. 4

DOOR HINGE WITH KNUCKLE CYLINDER HAVING A MAJOR BEVELED PORTION

BACKGROUND OF THE INVENTION

This invention concerns an improvement in loose pin butt hinges which are commonly attached along edges of doors and along complementary positions on door jams to hang doors.

The butt hinges usually have first and second plates with countersunk holes for receiving flat head screws or bolts for fixing the plates to the doors or jams. Plates are usually rectangular and usually fit on outer edges of doors and inner edges of jams. The plates may be similarly shaped or differently shaped. While it is usual to shape the plates as rectangles, one or both of the plates may have a triangular or other strap-like shape.

On swinging doors, butt hinges may be arranged with intermediate plates hinged between fixed plates.

In constructing butt hinges, it is traditional to construct one plate with an even number of knuckles or cylinders and another plate with an odd number of knuckles or cylinders, which interfit and align with the knuckles and cylinders of the first plate. It is conventional to construct one of the plates with three knuckles or cylinders and the other plate with two knuckles or cylinders, which respectively fit in spaces between the outer and center knuckles of the first plate. One plate may be fixed to a door jamb, the other fixed to a door.

It is conventional to construct the knuckles or cylinders in such a way that they project out from the door jamb, usually on the inside of the door so that the door swings open toward the room or space being entered. In conventional butt hinges, the knuckles are formed from extensions of the plate, which are turned and formed as cylinders. Alternatively, cylinders may be welded along edges of the plate.

Some butt hinges are constructed with decorative false pinheads inserted in lower ends of lower cylinders. Those decorative false pinheads remain fixed during the life of the hinge. In butt hinges which do not have the preexisting false pin heads, the hinges may be reversible so that the upper edge and lower edge are interchangeable.

Removable pin butt hinges are commonly used to hang doors, because the hinges are durable and dependable, and generally function effectively for the entire duration of the structure in which they are installed. Functionally, they are excellent; except that, by reason of structural design, they generally cause a singular but serious problem when for some reason a door must be temporarily removed. The problem is that where doors have been mounted for several years, both doors and hinges are painted many times, and while this does not affect their opening and closing, the accumulation of paint does bind the top of the hinge-pin to the uppermost knuckle of the hinge, almost like a steel weld, which makes it a horrible task to extract the pin for the removal of the door. Pin extraction is difficult because a tool such as a screwdriver must be driven between the crown of the pin and the adjacent surface of the hinge cylinder. A need exists for butt hinges or door hinges with more easily removable pins.

SUMMARY OF THE INVENTION

A modified butt hinge eliminates the problem of door hinge removal.

The butt hinge is identical to any conventional removable pin door hinge, except that the hinge of the present invention incorporates beveled surfaces on one of the end pin knuckles just under the crown of the pin. That bevel permits the pin, and consequently the door, to be more easily removed, as the bevel allows a worker to directly pound on the partially exposed lip of the pin crown with tools such as a screwdriver and hammer, rather than trying to pry between the edge of the crown and the adjacent edge of the pin cylinder. The butt hinge is installed as other hinges via flush-head wood screws passing through countersunk holes drilled in hinge mounting plates.

A modification of conventional removable pin butt hinges, such as used to hang doors, simplifies removal of the hinge pin. The modification is a beveled surface portion along an upper end edge of the uppermost hinge cylinder, providing access to an exposed ledge portion of the hinge pin crown. A driver, a chisel, a screwdriver or other driving device may be positioned against the exposed portion of the hinge pin and struck, thereby easily driving the hinge pin from the hinge cylinder.

This invention provides an improved loose pin butt hinge, such as used for mounting doors, lids and the like.

Two mounting plates of conventional design have connecting means, such as a plurality of countersunk screw holes, for attachment to flat surfaces.

A plurality of interconnecting hinge knuckles are provided along the respective edges of the two mounting plates closest to the pivot axis of the hinge. When interconnected, the knuckles form the body of a hollow cylinder. One of said knuckles forming one end of said hollow cylinder body has a beveled edge on a portion of the surface forming the cylindrical end.

A holding pin of any conventional design has a head with a flat surface for contact with the non-beveled portion of the beveled knuckle. When inserted through the hollow cylinder, the contact surface of the pin crown sits flush against the non-beveled portion of the cylinder end. A remaining surface portion of the crown forms an exposed surface over the beveled portion of the cylinder end.

A preferred loose pin butt hinge has first and second plates and has first and second series of interposed pin receiving cylinders fixed on abutting edges of the plates. A pin extends sequentially through the interfitted cylinders in the first and second series of cylinders. An end cylinder in one of the series has a bevel along an outer edge thereof for contacting an underside of a head of a pin for permitting pushing upon the underside of the head of the pin to remove the pin from the aligned cylinders.

Preferably the bevel is a flat bevel on a round cylinder.

Preferably the bevel is formed in a portion of the cylinder spaced from a plate to which that cylinder is connected. A second bevel at an opposite end of an opposite end cylinder permits the hinge to be used with either end up.

One bevel has a curved surface, which extends around an end of the hinge.

A preferred hinge has a first plate having first and second opposite ends and third and fourth edges arranged perpendicularly to the first and second ends. Plural cylinders are connected to the third edge. One of the cylinders has a circular end which is generally coplanar with at least a portion of the first end of the first plate. The plural cylinders are spaced along the third edge of the first plate for receiving therebetween at least one other cylinder. The hinge has a second plate having first and second opposite ends and third and fourth edges. At least one cylinder connected to the third edge of the second plate has dimensions for fitting within a space between at least two of the plural cylinders connected to the third edge of the first plate. Each of the cylinders has a bore. The plural cylinders connected to the first plate and the at least one cylinder connected to the second plate are interposed and aligned so that bores of the cylinders are aligned. A pin has an elongated shaft for fitting within the bores and has a head with an outer end surface and an inner end surface. The inner end surface is configured for overlying the first end of the first cylinder. The first end of the first cylinder has a lateral surface configured distinctly from surfaces of the remaining cylinders for exposing a portion of the inner surface of the head of the pin. The inner surface is engaged with a tool for driving the pin from the hinge.

Preferably the lateral surface adjacent the first end of the first cylinder has a bevel for exposing a portion of the inner surface of the head of the pin.

These and further and other objects and features of the invention are apparent in the disclosure, which includes the above and ongoing written specification, including the claim and the drawing.

BRIEF DESCRIPTION OF THE DRAWINGS

FIG. 1 shows a butt hinge of the present invention having a bevel.

FIG. 2 is a detail of the removal of a pin from a butt hinge.

FIG. 3 shows a butt hinge of the present invention having a beveled edge around the end knuckle.

FIG. 4 shows a butt hinge with a bevel at the top and bottom of the hinge.

DETAILED DESCRIPTION OF THE DRAWINGS

FIG. 1 illustrates an embodiment of the detachable butt hinge 1 with a beveled edge 17 for easy pin removal, a holding pin 21 with pin crown 23 having a flat bottom surface 25, and a plurality of hinge knuckles 7, 9, 11, 13 and 15 mounted along the edges of two mounting plates 3 and 5. The mounting plates having a plurality of countersunk screw holes 4.

In FIG. 1 the hinge knuckles are shown formed from extensions of the plates 3 and 5, which have been turned and rounded. Plate 3 has upper and lower knuckles 7 and 15. The upper knuckle is beveled 17 to provide access for a tool to the flat lower surface 25 of the pin 21. The shaft 27 of the pin extends through the central openings 29 of the cylinders when the knuckle cylinders 7, 9, 11, 13 and 15 have been aligned and interpositioned.

In FIG. 1, the opposite side of the upper knuckle is shown formed with a flattened bevel 19 to provide a different approach for a tool, should removal of the pin from that angle be desirable.

FIG. 2 shows the driving of a pin 21 from an upper knuckle 7 of a mounted door hinge 1. The knuckles project from the inside of door 31 and door jam 33. 35 represents a frame around a window 37 in the door 31. In removing the pin from the knuckles, it is conventional to use a tool 41, such as a chisel and a hammer 43. The beveling 17 of the outer surface of the upper knuckle 7 allows the tip 45 of the tool 41 to access the flat lower surface of the pin 21.

As shown in FIG. 3, a hinge 51 has a hinge plate 53 from which an upper knuckle 57 projects. A curved, tapering bevel 59 is formed around the entire circumference of the upper end of the knuckle 57 so that a tool may be used to access the underside 25 of the crown 23 of the pin from any angle.

As shown in FIG. 4, a hinge 61 has a hinge plate 63 with outer or lower and upper knuckles 65 and 67, and a center knuckle. Bevels 69 are formed along outer edges of the outer knuckles so that the hinge plate 63 and hinge 61 may be inverted and applied to the door or jam in either direction.

In each case, the bevel is a major beveled portion which is defined by a bevel surface extending over at least half of the length of a cylinder.

While the hinges shown in the drawings may be described as having upper and lower knuckles, it is obvious that the hinges may be used in a horizontal direction, such as on a trap door or on a cover of a chest. Providing the bevels along the outer edges of the hinge knuckles accomplishes the objects of the present invention, irrespective of the mounting attitude of the hinge plates, since it provides bevels to permit access to the hinge pins for driving, tapping or jarring the hinge pins loose from the internal diameters of the cylinders.

While the invention has been described with reference to specific embodiments, modifications and variations of the invention may be constructed without departing from the scope of the invention, which is described in the following claims.

I claim:

1. A hinge comprising a first plate having first and second opposite ends and third and fourth edges arranged perpendicularly to the first and second ends, plural cylinders connected to the third edge, a first one of the cylinders having an at least partially circular first end which is generally coplanar with at least a portion of the first end of the first plate, the plural cylinders being spaced along the third edge of the first plate for receiving therebetween at least one cylinder, the hinge having a second plate having first and second opposite ends and third and fourth edges, at least one cylinder connected to the third edge of the second plate and having dimensions for fitting within a space between at least two of the plural cylinders connected to the third edge of the first plate, each of the cylinders having a bore, and the plural cylinders connected to the first plate and the at least one cylinder connected to the second plate being interposed and aligned so that bores of the cylinders are aligned, a pin having an elongated shaft for fitting within the bores and having a head with an outer end surface and a flat inner end surface, the flat inner end surface being configured for overlying the first end of the first cylinder, the first end of the first cylinder having a lateral surface configured distinctly from surfaces of the remaining cylinders for exposing a portion of the flat inner end surface of the head of the pin, whereby the flat inner end surface may be engaged with a flat tool laid flat along a major beveled portion of the end cylinder for driving the pin from the hinge, wherein the lateral surface adjacent the first end of the first cylinder has a bevel for exposing the portion of the flat inner end surface of the head of the pin, the major beveled portion forming a long thin edge at the first end of the first cylinder.

2. The apparatus of claim 1, wherein the bevel is a flat bevel on a round cylinder.

3. The apparatus of claim 1, wherein the bevel is formed in a portion of the cylinder spaced from a plate to which that cylinder is connected.

4. The apparatus of claim 1, further comprising a second bevel at an opposite end of an opposite end cylinder on the same plate, whereby the hinge may be used with either end up.

5. The apparatus of claim 1, wherein the bevel comprises a curved surface.

6. The apparatus of claim 1, wherein the bevel extends around an end of the hinge.

* * * * *